US009602903B2

(12) United States Patent
Black et al.

(10) Patent No.: US 9,602,903 B2
(45) Date of Patent: Mar. 21, 2017

(54) LIGHT AND SOUND BAR SYSTEM

(71) Applicants: Robyn Wirsing Black, Swoyersville, PA (US); Matthew Seibert, Columbus, OH (US); Joel Beebe, Columbus, OH (US); Bret Gould, Worthington, OH (US)

(72) Inventors: Robyn Wirsing Black, Swoyersville, PA (US); Matthew Seibert, Columbus, OH (US); Joel Beebe, Columbus, OH (US); Bret Gould, Worthington, OH (US)

( * ) Notice: Subject to any disclaimer, the term of this patent is extended or adjusted under 35 U.S.C. 154(b) by 16 days.

(21) Appl. No.: 14/661,475

(22) Filed: Mar. 18, 2015

(65) Prior Publication Data

US 2015/0271584 A1 Sep. 24, 2015

Related U.S. Application Data

(60) Provisional application No. 61/955,202, filed on Mar. 18, 2014.

(51) Int. Cl.

| | |
|---|---|
| ***H04R 1/02*** | (2006.01) |
| ***F21V 33/00*** | (2006.01) |
| *F21V 15/01* | (2006.01) |

(52) U.S. Cl.

CPC ..... *H04R 1/028* (2013.01); *F21V 33/0056* (2013.01); *F21V 15/01* (2013.01); *H04R 2420/07* (2013.01); *H04R 2420/09* (2013.01); *H04R 2499/11* (2013.01)

(58) Field of Classification Search

CPC .... F21V 21/145; F21V 33/00; F21V 33/0052; F21V 33/0056; H04R 1/02; H04R 1/028; H04R 2499/11

See application file for complete search history.

(56) References Cited

U.S. PATENT DOCUMENTS

| | | | |
|---|---|---|---|
| 5,082,235 | A | 1/1992 | Crowther et al. |
| 5,122,941 | A | 6/1992 | Gross et al. |
| 5,292,099 | A | 3/1994 | Isham et al. |
| 5,379,201 | A | 1/1995 | Friedman |
| D366,478 | S | 1/1996 | Daniels et al. |
| 5,615,945 | A | 4/1997 | Tseng |
| 5,701,347 | A | 12/1997 | Daniels et al. |
| 5,738,320 | A | 4/1998 | Matos et al. |
| 5,812,369 | A | 9/1998 | Hsu et al. |

(Continued)

OTHER PUBLICATIONS

LE USB LED Flexible Lamp for Laptop, product description [online] [retrieved on Apr. 30, 2015]. Retrieved from the amazon.co.uk website using Internet <URL: http://www.amazon.co.uk/Flexible-Light-Laptop-Notebook-Electronics/dp/B00E9670TK>.

(Continued)

*Primary Examiner* — Thang Tran

(74) *Attorney, Agent, or Firm* — Benesch Friedlander Coplan & Aronoff, LLP; Thomas Y. Kendrick; Benjamen E. Kem

(57) ABSTRACT

A system is disclosed for providing enhanced sound and additional functionality to auxiliary devices. In one embodiment, a light and sound bar system comprising an omnidirectional high fidelity speaker; an adjustable lighting device; and attachment hardware for attaching to an auxiliary device is provided to add enhanced sound capabilities and lighting functionality to auxiliary devices.

19 Claims, 13 Drawing Sheets

(56) References Cited

U.S. PATENT DOCUMENTS

| | | | | |
|---|---|---|---|---|
| 5,947,434 | A | 9/1999 | Kosmoski et al. | |
| D416,765 | S | 11/1999 | Dankwardt et al. | |
| 5,996,957 | A | 12/1999 | Kurtz | |
| 6,015,132 | A | 1/2000 | Belle | |
| 6,149,001 | A | 11/2000 | Akins | |
| 6,311,946 | B1 | 11/2001 | Hoffman | |
| 6,367,946 | B1 | 4/2002 | Leifer et al. | |
| 6,527,237 | B2 | 3/2003 | Harary et al. | |
| 6,536,917 | B1 * | 3/2003 | Aperocho | F21V 33/0056 362/183 |
| 6,550,737 | B1 | 4/2003 | Sai et al. | |
| 6,600,827 | B2 | 7/2003 | Lu | |
| 6,680,844 | B2 | 1/2004 | Kim | |
| 7,004,596 | B2 | 2/2006 | Merrem | |
| 7,140,584 | B2 | 11/2006 | Bourque et al. | |
| 7,153,212 | B1 | 12/2006 | Karten et al. | |
| 7,296,696 | B2 | 11/2007 | Brennan et al. | |
| 7,393,242 | B1 | 7/2008 | Saje | |
| 7,559,520 | B2 | 7/2009 | Quijano et al. | |
| 7,631,979 | B1 | 12/2009 | Brown et al. | |
| 7,686,466 | B2 | 3/2010 | Lev et al. | |
| 7,717,389 | B2 | 5/2010 | Berman | |
| 7,793,905 | B2 | 9/2010 | Merritt et al. | |
| D630,222 | S | 1/2011 | Lin | |
| 7,921,997 | B2 | 4/2011 | Burns | |
| D641,610 | S | 7/2011 | Sedalo | |
| 8,042,781 | B2 | 10/2011 | Berman et al. | |
| 8,055,009 | B2 | 11/2011 | Porter | |
| 8,064,193 | B2 | 11/2011 | Thabit | |
| 8,254,102 | B2 | 8/2012 | Ye | |
| 8,418,977 | B2 | 4/2013 | Berman et al. | |
| 2006/0098403 | A1 * | 5/2006 | Smith | G06F 1/16 361/679.08 |
| 2006/0119104 | A1 * | 6/2006 | Wall | H02J 7/32 290/2 |
| 2007/0090007 | A1 | 4/2007 | Ames | |
| 2007/0188349 | A1 * | 8/2007 | Staniszewski | G07B 15/02 340/932.2 |
| 2007/0247790 | A1 * | 10/2007 | Proctor | H04R 3/00 361/679.23 |
| 2008/0132289 | A1 * | 6/2008 | Wood | H04B 1/3888 455/566 |
| 2010/0192811 | A1 | 8/2010 | Khalil | |
| 2012/0220256 | A1 * | 8/2012 | Tsuge | F21V 33/0056 455/343.1 |
| 2015/0187187 | A1 * | 7/2015 | Del Toro | H04M 1/7253 340/539.11 |
| 2015/0195633 | A1 * | 7/2015 | Elsasser | H04R 1/02 381/334 |
| 2015/0237847 | A1 * | 8/2015 | Madl | A01M 31/004 367/139 |

OTHER PUBLICATIONS

Dorcy LED USB Laptop Cliplight, product description [online] [retrieved on Apr. 30, 2015]. Retrieved from the amazon.com website using Internet <URL: http://www.amazon.com/Dorcy-41/1425-Laptop-Retractable-Adaptor/dp/B001PII7O2%3Fpsc%3D1%26SubscriptionId%3DAKIAIEDMUXAHKPNOXCIA%26tag%3Dphoot3-20%26linkCode%3Dxm2%26camp%3D2025%26creative%3D165953%26creativeASIN%3DB001PII7O2>.

GoalZero Luna USB LED Light Stick, product description [online] [retrieved on Apr. 30, 2015]. Retrieved from from Crutchfield website using Internet <URL: http://www.crutchfield.com/S-JZkZQ9xfYp8/p_79714101/Goal-Zero-Luna-LED-Light.html>.

Mr Brightside Book Light, product description [online] [retrieved on Apr. 30, 2015]. Retrieved from use.com website using Internet <URL: http://tonytrilex.use.com//message-show/5a9afd4cOce8df16b063511640334688/3f5fa4b36c7b661b778c22e278b91597>.

Enhance Flexbeam USB Laptop Lamp, product description [online] [retrieved on Apr. 30, 2015]. Retrieved from Build PC Gaming website using Internet <URL: http://www.buildpcgaming.com/see-enhance-flexbeam-usb-flexible-clip-on-laptop-lamp-work-light-w-7-led-lights-clip-on-clamp-for-laptops-desktop-computers-note-books-select-tablets/>.

Logix USB LED Light, product description [online] [retrieved on Apr. 30, 20150]. Retrieved from amazon.com website using Internet <URL: http://www.amazon.com/Logiix-10151-USB-White-Light/dp/B002NKM2HE>.

HDE Portable USB LED Work Light, product description [online] [retrieved on Apr. 30, 2015]. Retrieved from Cues Home Shopping Network website using Internet <URL: http://angwebstore.com/hde-portable-usb-led-flexible-work-light-for-laptops-notebooks>.

Neewer Portable USB Netbook Speaker, product description [online] [retrieved on Apr. 30, 2015]. Retrieved from amazon.com website using Internet <URL: http://www.amazon.com/Portable-White-Netbook-notebook-Speakers/dp/B00BODODNC/ref=sr_1_8?s=pc&ie=UTF8&qid=1430432230&sr=1-8&keywords=Neewer+speaker>.

Ritelite USB Touch Computer Light, product description [online] [retrieved on Apr. 30, 2015]. Retrieved from la website using Internet <URL: https://sites.google.com/a/fmj.eklp.info/la/p>.

Zelco Computer Light, product description [online] [retrieved on Apr. 30, 2015]. Retrieved from amazon.com website using Internet <URL: http://www.amazon.com/Zelco-1610-Computer-Light/dp/B00000J6X5>.

Elago Portable USB Flexible Light, product description [online] [retrieved on Apr. 30, 2015]. Retrieved from amazon.com website using Internet <URL: http://www.amazon.com/Portable-Flexible-Light-Laptops-Desktops/dp/B006G4SRXQ>.

Quirky Mantis Clip-On LED Task Lamp, product description [online] [retrieved on Apr. 30, 2015]. Retrieved from Quirky website using Internet <URL: http://www.quirky.com/shop/77>.

Logic Light LED Keyboard Light, product description [online] [retrieved on Apr. 30, 2015]. Retrieved from logickeyboard website using Internet <URL: http://www.logickeyboard.com/shop/logiclight%99-bundle-black-2770p.html>.

Impecca Zoo Tunes Portable Speaker, product description [online] [retrieved on Apr. 30, 2015]. Retrieved from IMPECCA website using Internet <URL: http://www.impeccausa.com/compact-portable-character-speaker-1060.html>.

GOgroove Sonaverse USB Soundbar, product description [online] [retrieved on Apr. 30, 2015]. Retrieved from BESTBUY website using Internet <URL: http://www.bestbuy.com/site/gogroove-sonaverse-usb-clip-on-soundbar-laptop-speaker-for-apple-toshiba-mac-samsung-sony-more-multi/1306869582.p?id=mp1306869582& skuld=1306869582>.

JLab USB Laptop Speakers, product description [online] [retrieved on Apr. 30, 2015]. Retrieved from Walmart website using Internet <URL: http://mobile.walmart.com/ip/JLab-USB-Laptop-Speakers-Pink/20512296>.

AQ Amigo Laptop Speaker, product description [online] [retrieved on Apr. 30, 2015]. Retrieved from GEEK website using Internet <URL: http://www.geek.com/gadgets/aq-amigo-screen-mounted-portable-speaker-launches-971892/>.

JLab USB Laptop Speakers, product description [online] [retrieved on Apr. 30, 2015]. Retrieved from SLASH GEAR website using Internet <URL: http://www.slashgear.com/jlab-b-flex-x-bass-laptop-speaker-adds-some-boom-252106601>.

Panda Pal Portable Mini Media Speaker, product description [online] [retrieved on Apr. 30, 2015]. Retrieved from BEST BUY website using Internet <URL: http://www.bestbuy.com/site/gogroove-panda-pal-portable-kids-animal-speaker-system-for-smartphones-tablets-more-multi/1306755052.p?id=mp1306755052& skuld=1306755052>.

GOgroove Sonawave Clip-On Speaker, product description [online] [retrieved on Apr. 30, 2015]. Retrieved from amazon.com website using Internet <URL: http://www.amazon.com/GOgroove-SonaWAVE-USB-Clip--Plug-n-Play/dp/B00BBH4GMY/ref=sr_1_cc_2?s=aps&ie=UTF8&qid=1430431557&sr=1-2-catcorr&keywords=SonaWave>.

(56) References Cited

OTHER PUBLICATIONS

CreativeLabs TravelSound Speaker, product description [online] [retrieved on Apr. 30, 2015]. Retrieved from amazon.com website using Internet <URL: http://www.amazon.com/dp/B00070FRJM>.
Logitech Usb Laptop Speaker, product description [online] [retrieved on Apr. 30, 2015]. Retrieved from amazon.com website using Internet <URL: http://www.amazon.com/Logitech-USB-Laptop-Speaker-Z305/dp/B003VAK1I2/ref=sr_1_1?s=electronics&ie=UTF8&qid=1430431769&sr=1-1&keywords=Logitech+Z305>.
iKross Black Dual LED Clip-On, product description [online] [retrieved on Apr. 30, 2015]. Retrieved from amazon.com website using Internet <URL: http://www.amazon.com/iKross-Clip-On-Reading-Readers-Smartphone/dp/B00BXXOQVQ/ref=cm_cd_ql_qh_dp_t>.

* cited by examiner

LIGHT AND SOUND BAR SYSTEM

CROSS-REFERENCE TO RELATED APPLICATIONS

This application claims priority from U.S. Provisional Patent Application No. 61/955,202, filed on Mar. 18, 2014, which is incorporated by reference herein in its entirety.

BACKGROUND

Portable computing devices are common features of everyday life. This area of technology is rapidly changing, creating an ever growing number of portable computing devices in smaller package sizes such as laptop computers, tablet computers, and smartphones. Often, high quality features such as processing capability, storage, display, camera, and sound output associated with larger computing devices are sacrificed in portable computing devices for the sake of portability and size. What is needed is a high-fidelity, add-on speaker system with additional functionality such as light for use with portable consumer electronics and portable computing devices.

SUMMARY

In one embodiment, a portable light and sound bar system is provided, the portable light and sound bar system comprising: a housing; an omnidirectional high fidelity speaker; an adjustable lighting device; an electrical input; a power source; and an attachment hardware.

In another embodiment, a portable light and sound bar system is provided, the portable light and sound bar comprising: a housing, the housing comprising an inner volume for supporting at least one of: a power source, a circuit, and a storage area, the housing further comprising an outer surface for supporting at least one of: an omnidirectional high fidelity speaker output, an adjustable lighting device, and an attachment interface for interfacing with an attachment hardware, the housing further comprising a swivel for rotably adjusting at least a portion of the housing comprising the omnidirectional high fidelity speaker and the adjustable lighting device thereon; an omnidirectional high fidelity speaker; an adjustable lighting device operatively connected to the housing; an electrical input; a power source; and an attachment hardware, the attachment hardware operable to connect to either the attachment interface on the outer surface of the housing, or directly to the outer surface of the housing, wherein the attachment hardware is selectively removable from the attachment interface and outer surface housing.

In another embodiment, a portable light and sound bar system is provided, the portable light and sound bar system comprising: a housing, the housing comprising an inner volume for supporting at least one of: a power source; a circuit; and a storage area; the housing further comprising an outer surface for supporting at least one of: a grille to protect an omnidirectional high fidelity speaker; an adjustable lighting device; an actuation device for controlling the portable light and sound bar system; an electrical connector operable to either connect to an external power source, or input a wired or wireless audio signal; and an attachment interface for interfacing with attachment hardware, the housing further comprising: an access panel on the outer surface for access to at least portion of the inner volume; at least one swivel for rotably adjusting at least a portion of the housing comprising the omnidirectional high fidelity speaker and the adjustable lighting device thereon; and a machined indentation for holding and supporting at least one of: a writing device, and a paper; an omnidirectional high fidelity speaker, the omnidirectional high fidelity speaker comprising at least one of: a preamplifier; an amplifier; a driver, the driver selected from the group of: a subwoofer, a woofer, a mid-range, a tweeter, and a supertweeter; a crossover; an enclosure; an electrical connection; and one or more grille; an adjustable lighting device operatively connected to the housing, the adjustable lighting device connecting to the housing by at least one of: a ball and socket attachment, a multi-directional swivel, and a flexible arm; a power source; and an attachment hardware, the attachment hardware operable to connect to the attachment interface on the outer surface of the housing, wherein the attachment hardware is selectively removable from the attachment interface.

BRIEF DESCRIPTION OF THE DRAWINGS

The accompanying figures, which are incorporated in and constitute a part of the specification, illustrate various example systems, and are used merely to illustrate various example embodiments.

DETAILED DESCRIPTION

Figure 1:
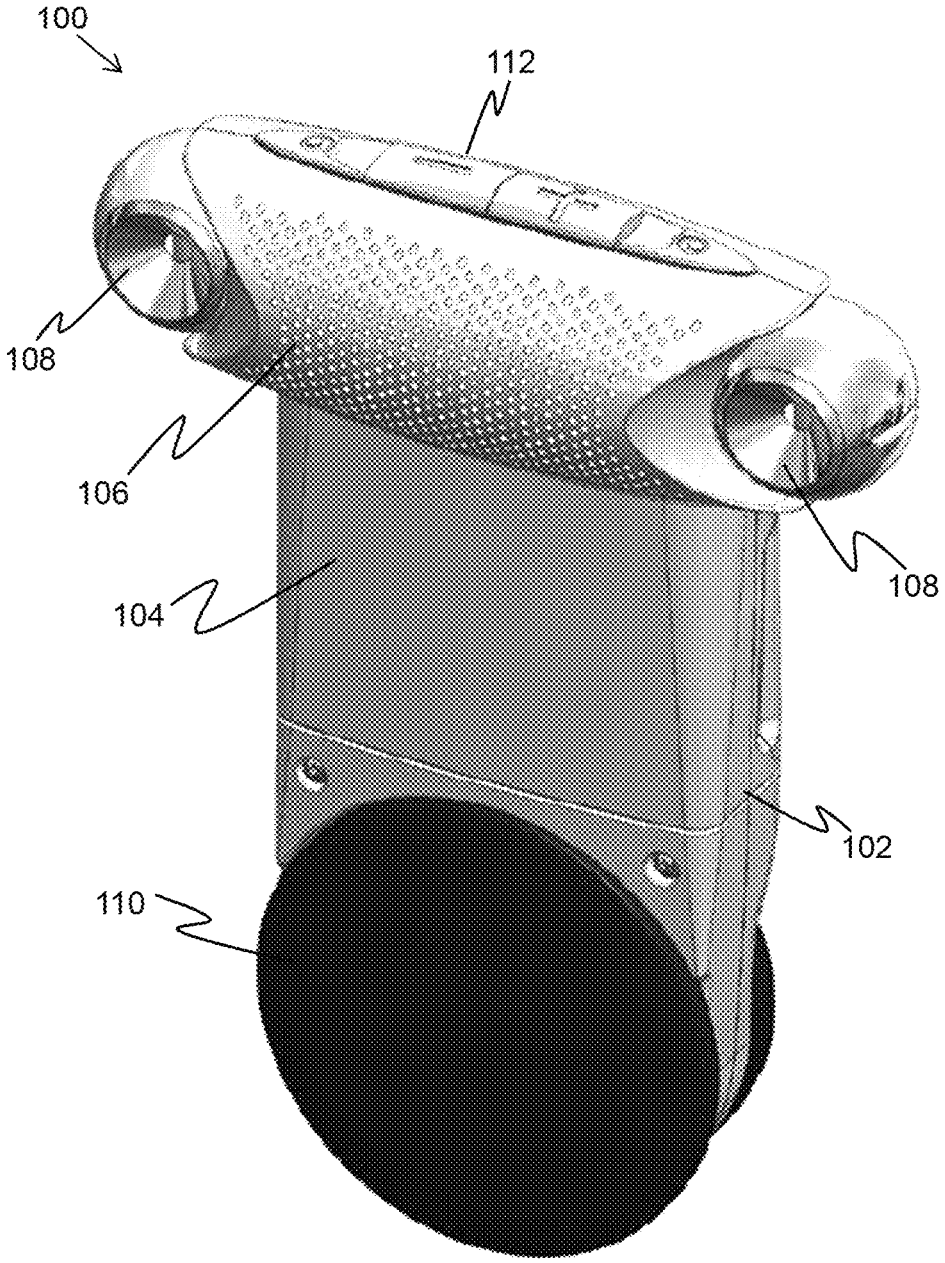
FIG. 1 illustrates a perspective view of a light and sound bar system.

FIG. 1 illustrates a perspective view of a light and sound bar system 100. Light and sound bar system 100 may be used with portable consumer electronics and portable computing devices in place of pre-existing sound systems found in these portable devices to provide an improved sound output while adding an additional functionality such as directional lighting, document support, and storage. Light and sound bar system 100 may comprise a housing 102. Housing 102 may comprise both an outer surface 104 and an inner volume (not shown). Outer surface 104 may operatively connect to various components of light and sound bar system 100, while the inner volume may house various internal components of light and sound bar system 100, as well as providing a storage area. An audio output of one or more high fidelity speaker contained within inner volume of housing 102 may broadcast high fidelity sound through a grille 106. One or more adjustable lighting device 108 may connect to outer surface 104 of housing 102 to provide directional lighting. An attachment hardware 110 may be used to secure light and sound bar system 100 to a portable electronic device, wall, or table. One or more actuation device 112 may be used to control a functionality of light and sound bar system 100.

Housing 102 may be of any material suitable for every day, repetitive use such as metal, polymeric material, wood, and the like. In one embodiment, housing 102 is easily mass produced using a known manufacturing technique such as stamping, injection molding, and the like. Housing 102 may be one part or an assembly of two or more parts such as a front housing and rear housing joined together using a common mechanical fastener, adhesive, ultrasonic weld, and the like.

Housing 102, grille 106, lighting device 108, actuation device 112, and other components of light and sound bar system 100 on or around outer surface 104 of housing 102 may be waterproofed to prevent an ingress of water into these components and into inner volume of housing 102. Waterproofing techniques such as rubber gaskets and o-rings, use of sealants and adhesives, and various unidirectional and semi-permeable membranes may be used to waterproof all or portions of light and sound bar system 100 to prevent liquids and other moisture from accumulating in, and corroding, overloading, or shorting any components within inner volume of housing 102, or affecting any components on or around outer surface 104 of housing 102.

Outer surface 104 of housing 102, and housing 102 in general may be machined, manufactured, and molded to provide a variety of features. In one embodiment, at least part of housing 102 is perforated with one or more hole to form grille 106. Perforations of grille 106 may allow high fidelity sound produced from one or more high fidelity speaker within inner volume of housing 102 to be transmitted externally. In another embodiment, housing 102 may be over-molded about one or more adjustable lighting device 108 to provide one or more attachment point for, or add stability to, one or more adjustable lighting device 108. In another embodiment, outer surface 104 of housing 102 may be molded to accommodate an attachment hardware 110 or one or more actuation device 112.

Figure 2B:
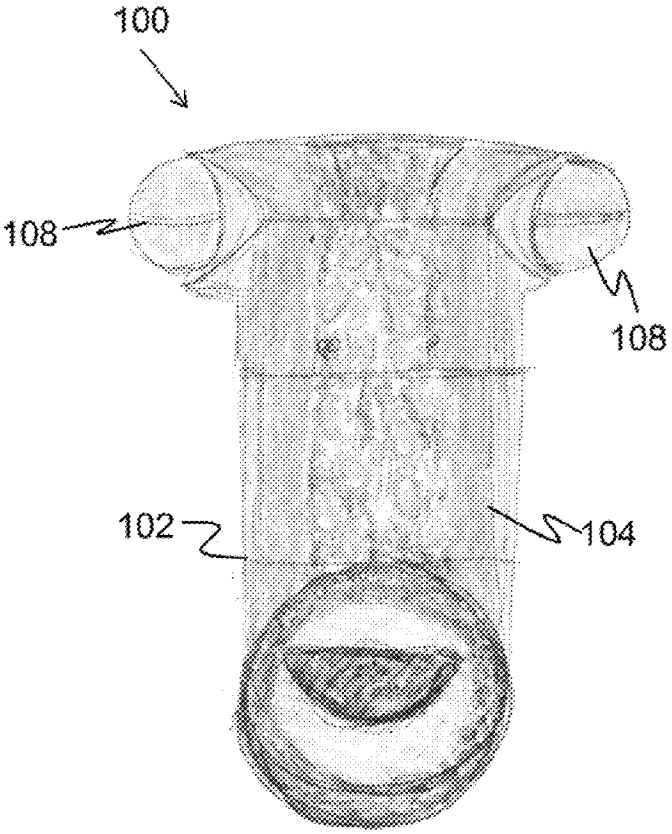
FIG. 2B illustrates a perspective view of a light and sound bar system.
Figure 2A:
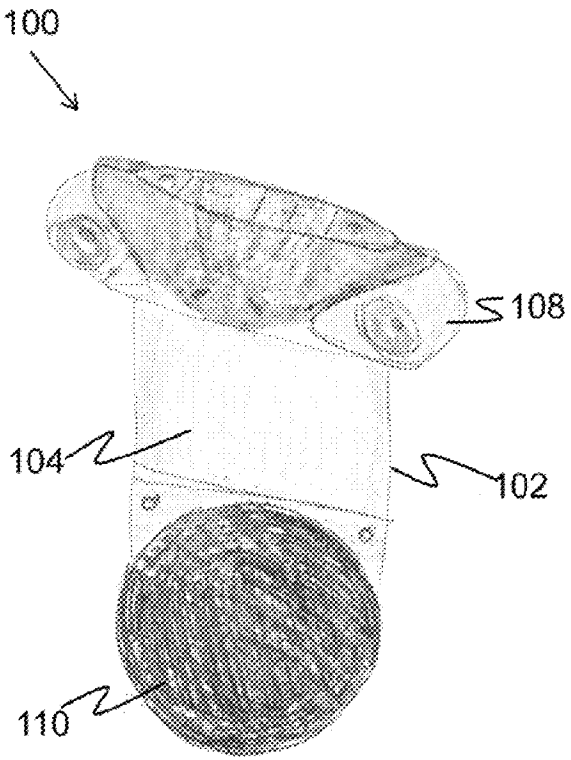
FIG. 2A illustrates a perspective view of a light and sound bar system.

Referring to FIGS. 2A and 2B, outer surface 104 of housing 102 may be molded in a shape of an animal, other creature or whimsical shape so that lighting devices 108 appear as animal or creature eyes, and attachment hardware 110 appears as an animal or creature appendage, torso, or other body part. In one embodiment, an outer skin or jacket (not shown) fits over light and sound bar system 100 to give an animal, creature, or whimsical shape appearance to light and sound bar system 100. FIGS. 2A and 2B show a light and sound bar system 100 having a reptilian appearance.

Referring to FIG. 1, one or more adjustable lighting device 108 may include various subassemblies such as connection hardware, wiring, reflectors, lenses, lighting components, and the like to produce and direct light. Lighting components may be lighting components common in the art such as incandescent bulbs, halogen bulbs, light emitting diodes (LEDs), and the like. In one embodiment, lighting components of lighting device 108 are LEDs used to produce both white light and light of different colors.

Actuation device 112 may be one or more button used to control various functionality of light and sound bar system 100. In one embodiment, a button to control power to a light and sound bar system 100, a button to control power to a left side lighting device, a button to control power to a right side lighting device, a button to increase a loudness of high fidelity speaker sound output (volume), and a button to decrease loudness of high fidelity speaker sound output (volume) are provided. In another embodiment, actuation device 112 is a switch used to control various functionality of light and sound bar system 100. In another embodiment, actuation device 112 may be a knob that, when rotated, controls power to light and sound bar system 100, and loudness of high fidelity speaker sound output (volume). In another embodiment, actuation device 112 may be a knob used to control an intensity of light output from lighting device 108 such as a dimmer switch.

Figure 3:
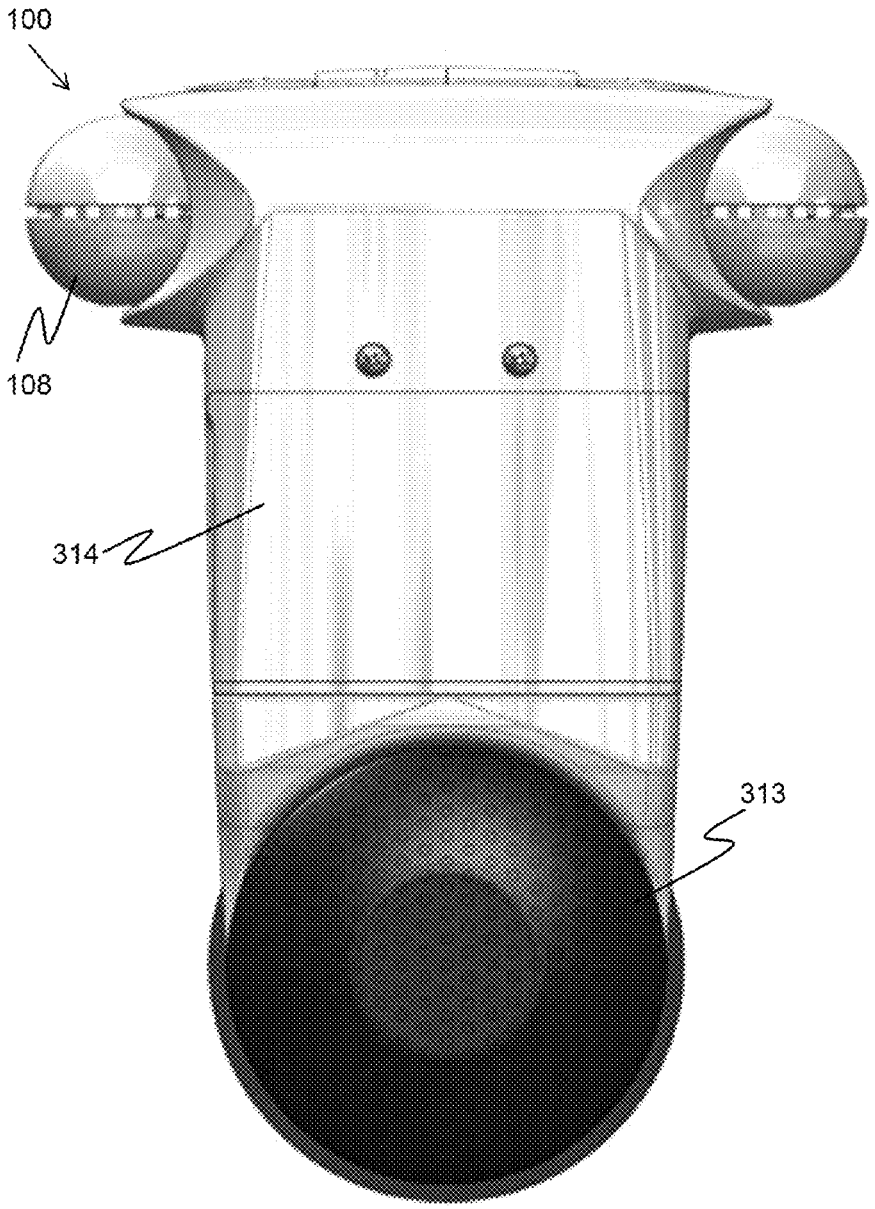
FIG. 3 illustrates a perspective view of a light and sound bar system.

With reference to FIG. 3, another perspective view of light and sound bar system 100 is illustrated. Outer surface 104 of housing 102 may have access panel 314 on a portion thereon for access to inner volume of housing 102. Outer surface 104 may also include attachment hardware control 313 to control attachment hardware 110.

Access panel 314 may be machined, molded, or manufactured to include certain features such as a finger hold to assist a user in detaching access panel 314 from housing 102. Access panel 314 may be readily removable or attached to housing 102 with one or more mechanical fastener requiring a tool for removal. In one embodiment, access panel 314 is attached to housing 102 with a push fitting requiring some manipulation by a user to detach access panel 314. In another embodiment, access panel 314 is secured to housing 102 with one or more screw; and the screw must be removed before access panel 314 can be removed.

In another embodiment, access panel 314 is secured to housing 102 with a hinge or like hardware to allow access panel 314 to be opened without complete removal of access panel 314 from housing 102.

Attachment hardware control 313 may be used to control attachment hardware 110. In one embodiment, attachment hardware 110 is a suction device and attachment hardware control 313 interfaces with attachment hardware 110 to flatten the suction device, expelling air to create a suction seal for attaching light and sound bar system 100 to an electronic device, table, or wall. In one embodiment, attachment hardware control 313 is a dial, that when rotated, adds and removes suction to suction cup attachment hardware 110. In another embodiment, attachment hardware control 313 is a lever, that when actuated, adds and removes suction to suction cup attachment hardware 110.

Figure 4:
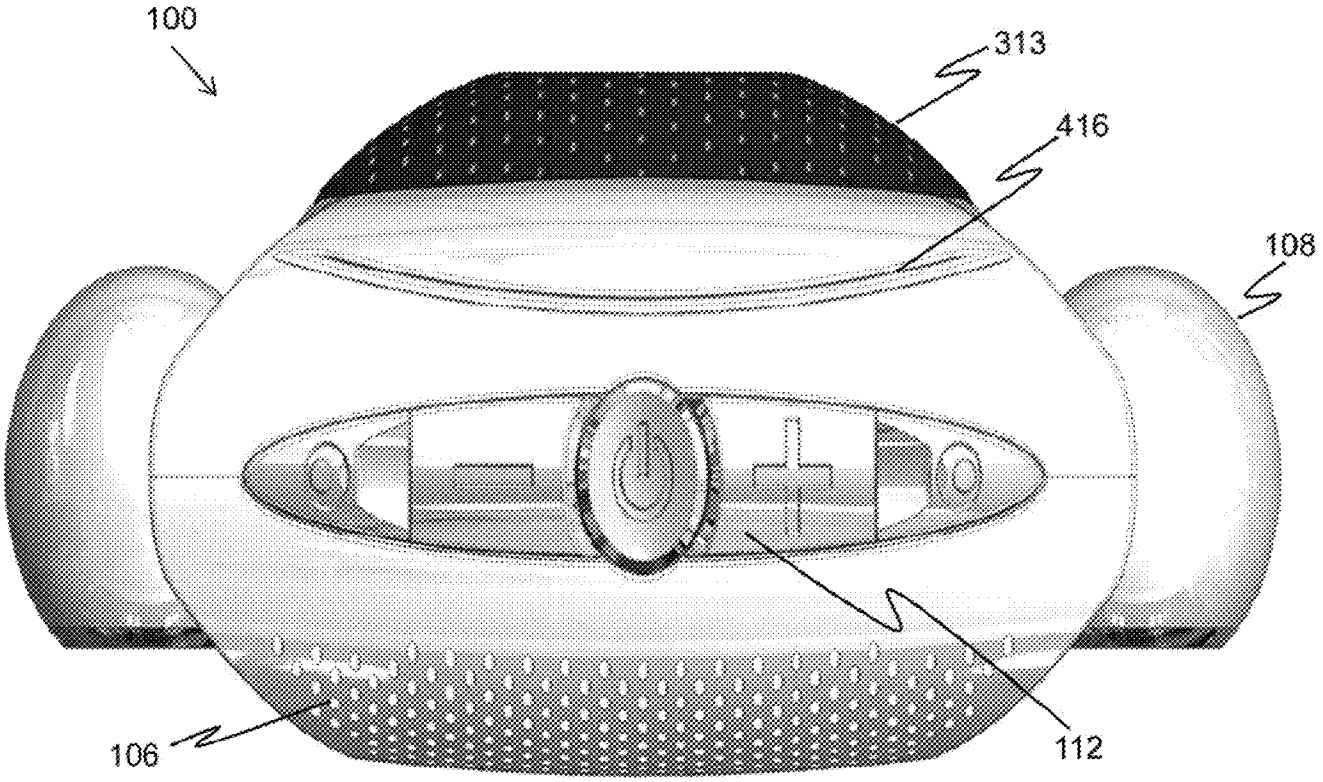
FIG. 4 illustrates a top view of a light and sound bar system.

With reference to FIG. 4, a top view of light and sound bar system 100 is illustrated. Outer surface 104 of housing 102 may have a feature such as holding indentation 416 molded or machined therein to provide a notch to hold documents, cards, and papers. In one embodiment, holding indentation 416 is molded or machined to provide a secure attachment for holding writing instruments such as a pen, pencil, or stylus. Holding indentation 416 may be a shallow indentation designed to grasp a writing instrument such a pencil, pen, or stylus, or holding indentation 416 may be a deep indentation to hold a pencil, pen, or stylus similar in operation to a pencil cup.

Figure 5:
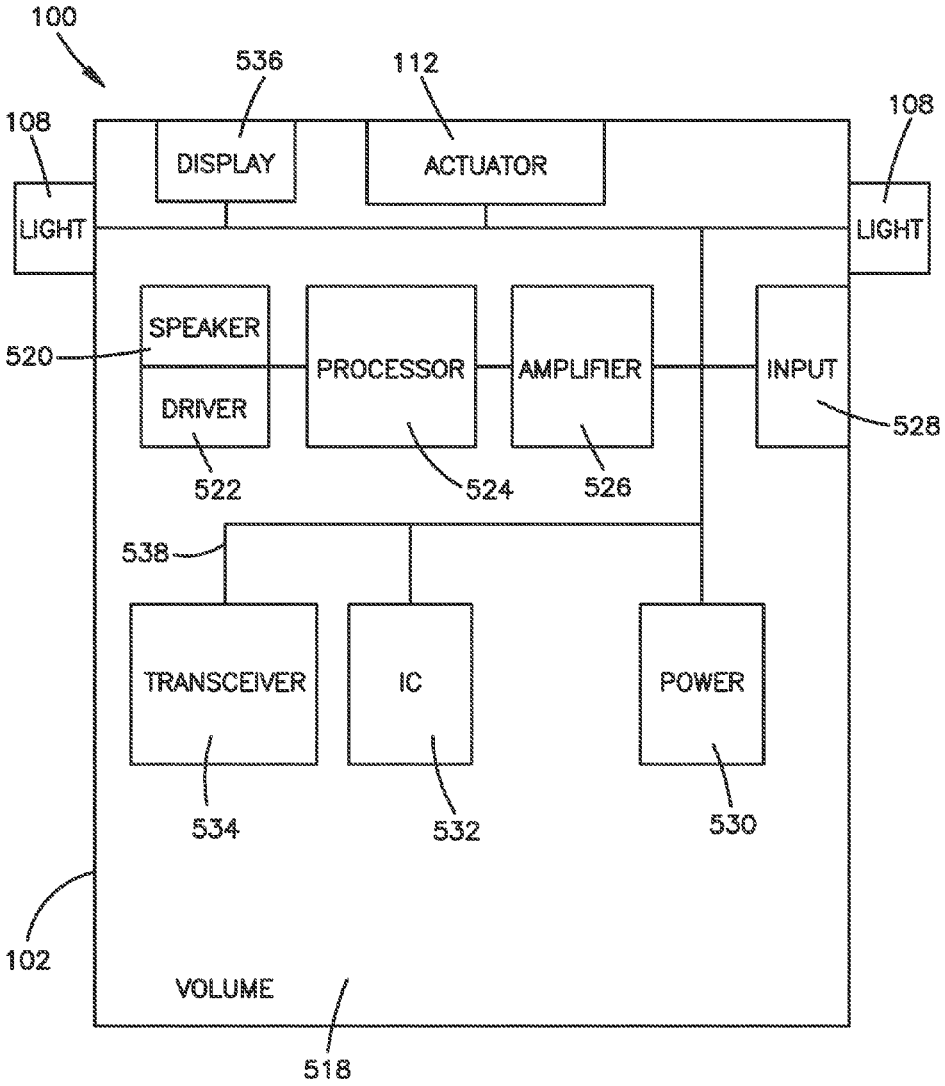
FIG. 5 illustrates a schematic view of a light and sound bar system.

With reference to FIG. 5, a schematic view of electrical components on housing 102 and within inner volume 518 of housing 102 is illustrated. Electrical components within inner volume 518 may include one or more speaker 520, filter or signal processing device 524, amplifier or preamplifier 526, electrical input 528, power source 530, CPU/memory/Integrated Circuit (IC) 532, transceiver (TX/RX) 534, display/indicator 536, connected by one or more circuit 538.

Speaker 520 may include one or more driver 522. Driver 522 may be any one of: a subwoofer, a woofer, a mid-range, a tweeter, and a supertweeter. Filter or signal processing device 524 may be a crossover used to separate different frequencies of an audio signal to route them to appropriate driver 522. In one embodiment, filter or signal processing device 524 is one or more of: a tuner, a demodulator used to output an audio signal from a radio wave to speaker 520. In another embodiment, filter or signal processing device 524 is a decoder used to decode an electronic audio format (e.g. MP3 file) input into light and sound bar system 100 to output an audio signal to speaker 520. Amplifier or preamplifier 526 may be used to amplify an audio signal before being output to speaker 520.

Electrical input 528, may be used to input signals and electricity into light and sound bar system 100. In one embodiment electrical input 528 is a standard, 3.5 mm AUX jack for inputting/outputting audio signals to and from light and sound bar system 100 via an AUX cord, headphone jack, and the like. In another embodiment, electrical input 528 is another audio jack such as an RCA jack or other phone jack, or a speaker terminal or binding post. In another embodiment, electrical input 528 is an internal or external antenna for transmitting and receiving radio waves. In another embodiment, electrical input 528 is one of: a universal serial bus (USB) plug, a micro USB plug, a IEEE 1394 (Firewire®) connection, a serial connection, and a parallel connection for inputting both data signals (including audio signals) and/or power into light and sound bar system 100, and outputting data signals from light and sound bar system 100. In another embodiment, a memory card reader such as an SD™card slot is electrical input 528 and used to input an audio signal into light and sound bar system 100. In another embodiment, electrical input 528 is a DC power jack used to connect light and sound bar system 100 to a DC transformer and the like. In another embodiment, electrical input 528 may be a retractable AUX cord connected to circuit 538 and stored in inner volume 518 that may be drawn out of inner volume 518 to connect to a sound output jack of another electrical device so as to provide a sound signal to speaker 520.

Power source 530 may include one or more electrical battery used to power light and sound bar system 100. In one embodiment, power source 530 is a primary, single-use battery that must be replaced when discharged. In another embodiment, power source 530 is a rechargeable battery of the type: nickel cadmium (NiCd), nickel metal hydride (NiMH), lithium ion (Li-ion), lithium ion polymer (Li-ion polymer), and the like. In another embodiment, power source 530 is a hardwire connection to AC line voltage or a transformer to convert AC line voltage into a DC voltage.

CPU/memory/IC 532 may be any combination of processor, memory, and one or more IC to provide additional functionality to light and sound bar 100. In one embodiment, CPU/memory/IC 532 is a memory and decoder used to store and decode a format such as an MP3 digital audio file to be output as an audio signal to speaker 520. Memory 532 may also be an electrical input 528 for light and sound bar 100 by inputting, for example, MP3 files into circuitry 538 of light and sound bar system 100. In another embodiment, CPU/memory/IC 532 may be programmed to control the functionality of light and sound bar 100. In another embodiment, CPU/memory/IC 532 may be used to process incoming sound signals before being output to speaker 520.

TX/RX 534 may be used to receive wireless sound signals to be output to speaker 520. In one embodiment, TX/RX 534 is a Bluetooth® transceiver for wirelessly receiving and transmitting signals between light and sound bar 100 and a Bluetooth® enabled electronic device. TX/RX 534 may also be an electrical input 528 for light and sound bar system 100.

Display/indicator 536 may be used to provide additional functionality to light and sound bar 100. In one embodiment display/indicator 536 is a light such as an LED to indicate functionality of light and sound bar 100. In another embodiment, display/indicator 536 is a thin-film display such as and LED or LCD with touchscreen capability to display such information such as song information, an interactive menu, and the like.

Circuit or circuitry 538 may be used to interconnect various electrical components of light and sound bar system 100. In one embodiment, circuit 538 is a wire or ribbon cable used to connect various electrical components. In another embodiment, circuit 538 is a printed circuit board (PCB) used to interconnect various electrical components of light and sound bar system 100.

Figure 6:
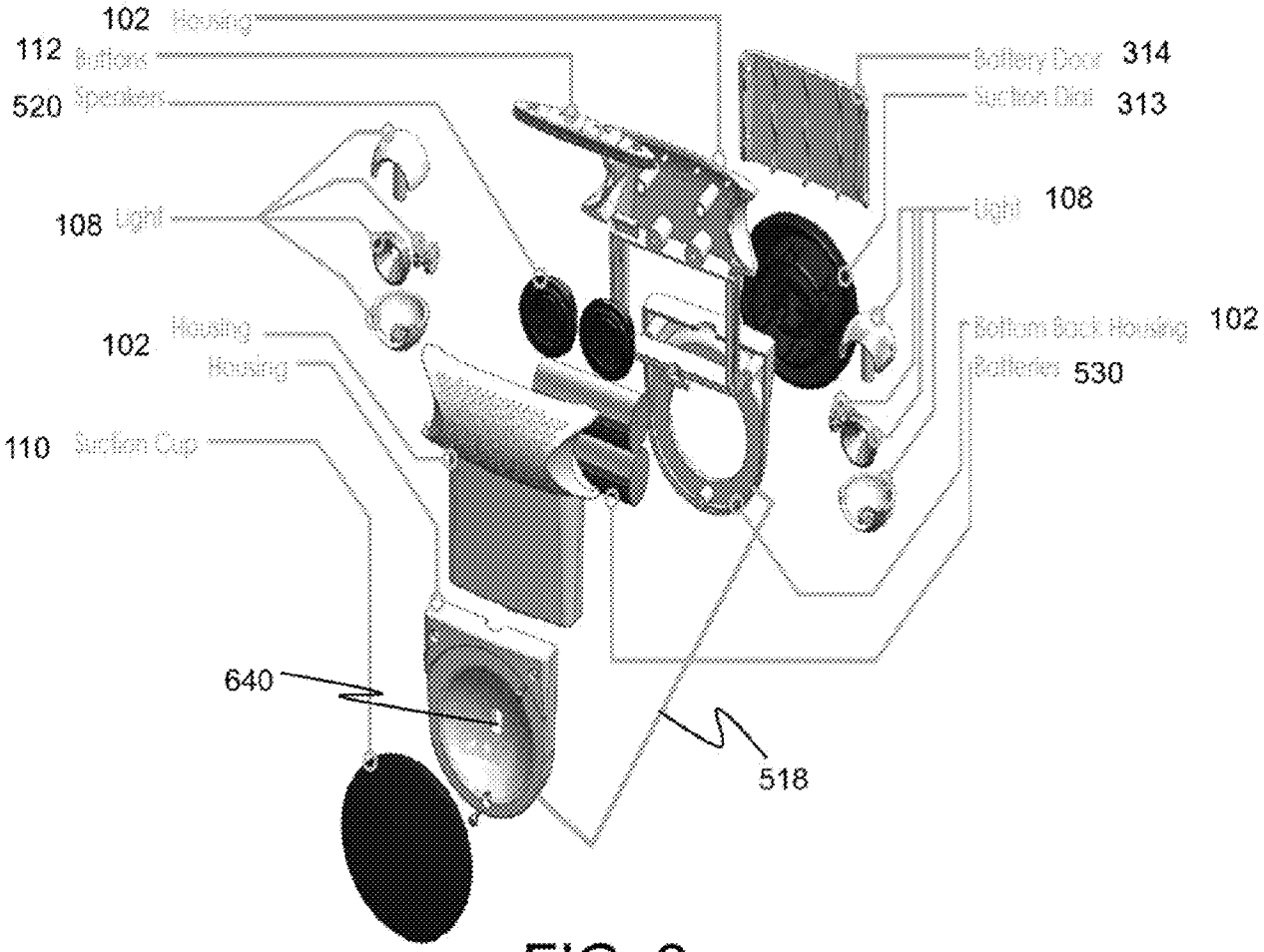
FIG. 6 illustrates an exploded view of one embodiment of a light and sound bar system.

With reference to FIG. 6, an exploded view of one embodiment of light and sound bar system 100 is illustrated. In one embodiment, inner volume 518 is the area bound by housing assemblies 102. Outer surface 104 of housing 102 may include attachment hardware interface 640 for attaching attachment hardware 110 to housing 102. In one embodiment, attachment hardware interface is a keyhole/buttonhole that interfaces with a raised button/key (not shown) on attachment hardware 110 for connecting attachment hardware 110 to housing 102. In one embodiment, attachment hardware 110 is a suction cup that is easily removed from housing 102 so that a user can wash suction cup attachment hardware 110 so as to maintain a high degree of suction on attachment hardware 110.

Figure 7:
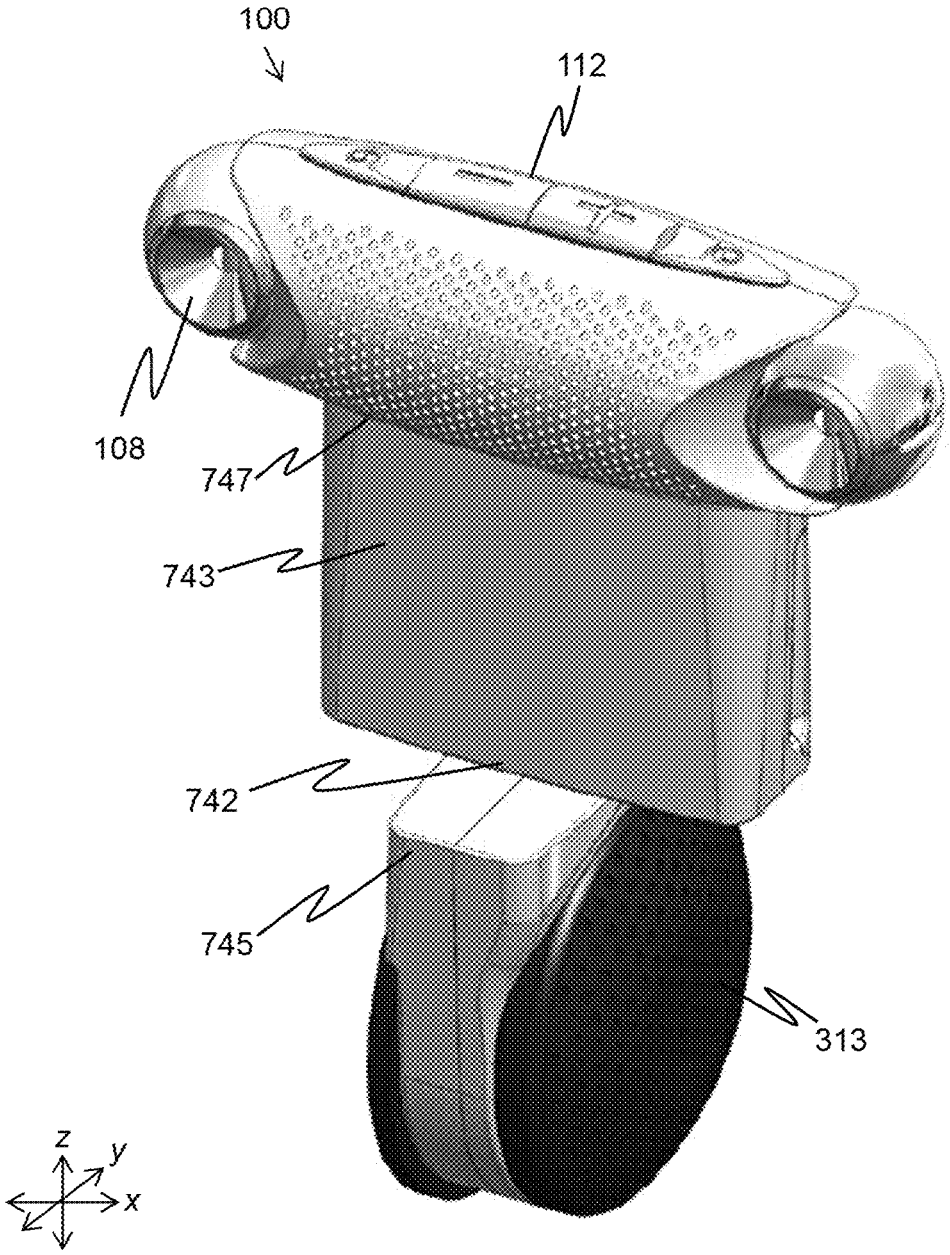
FIG. 7 illustrates a perspective view of one embodiment of a light and sound bar system.

Referring to FIG. 7, a perspective view of light and sound bar system 100 showing a swivel embodiment is illustrated. In one embodiment, light and sound bar system 100 includes a swivel 742 such that a portion of light and sound bar system 100 can swivel to better direct sound and light output. Swivel 742 may be any swivel hardware common in the art, and may include both swivel and tilt capabilities. In one embodiment, swivel 742 includes detents and stops to provide rotation of a portion of light and sound bar system 100 in fixed increments (e.g., rotation is provided in 10 degree increments). In another embodiment, swivel 742 includes a stop to prevent rotation of portion of light and sound bar system 100 past 360 degrees.

Swivel 742 may divide light and sound bar system 100 into two distinct portions such as upper housing 743 and lower housing 745. Lower housing 745 may comprise attachment hardware control 313 to control an attachment of attachment hardware onto a surface of an auxiliary device, such as a laptop, cell phone, or tablet. Upper housing 743 may include overhang 747 for stabilizing light and sound bar on multiple planar surfaces of an auxiliary device. For example, overhang 747 may fit over an upper edge of a computer monitor such that overhang 747 supports upper housing 743 of light and sound bar on any surface in the xy-plane (e.g. top edge of a computer monitor) to mitigate the effect of gravity, while portions of upper housing 743 and lower housing 745 may rest against surfaces in the xz-plane (e.g. back surface of a computer monitor), with lower housing 745 fixedly attached to surfaces in the xz-plane via attachment hardware.

Figures 8A, 8B, 8C:
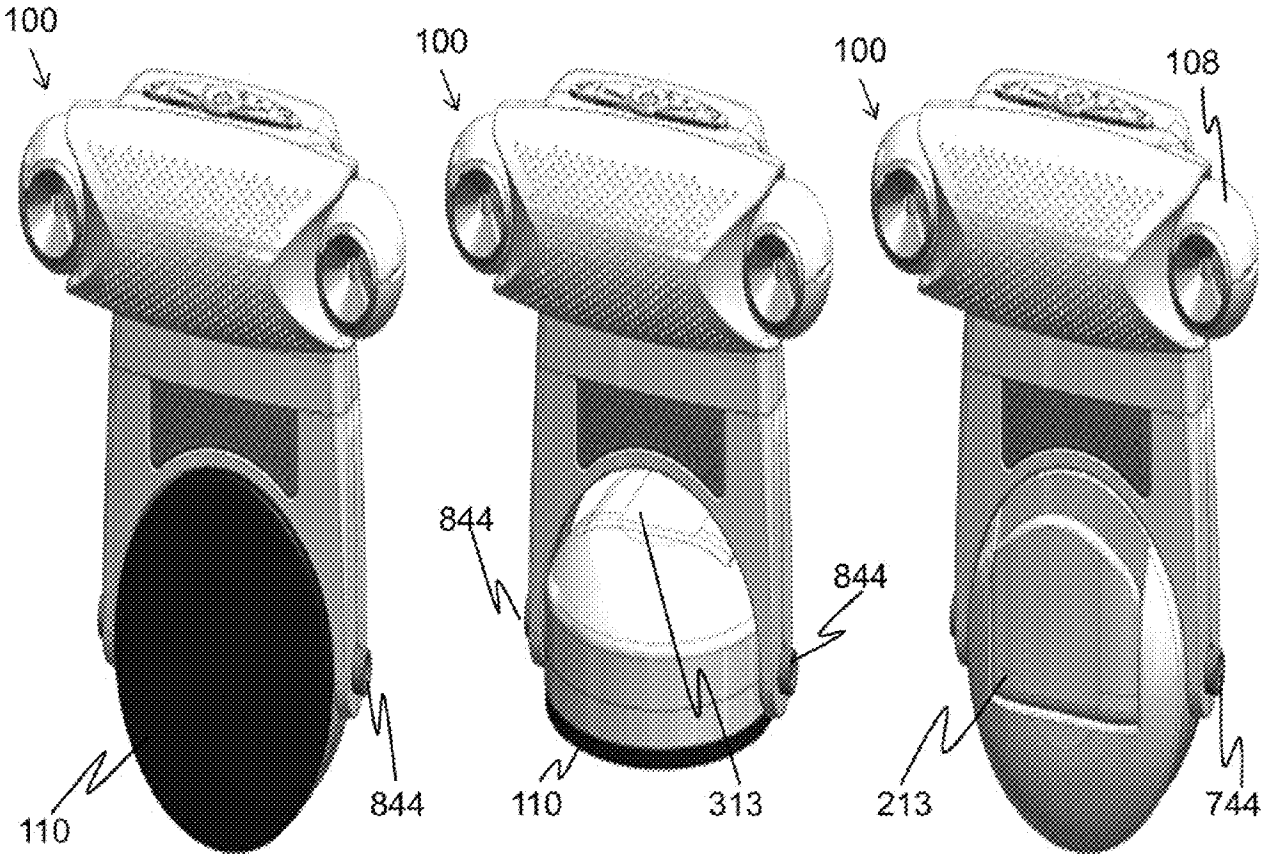
FIG. 8A illustrates a perspective view of one embodiment of a light and sound bar system.
FIG. 8B illustrates a perspective view of one embodiment of a light and sound bar system.
FIG. 8C illustrates a perspective view of one embodiment of a light and sound bar system.

Referring to FIGS. 8A, 8B, and 8C, perspective views of light and sound bar system 100 showing a swivel embodiment is illustrated. In one embodiment, light and sound bar system 100 includes a swivel 844 to rotate attachment hardware 110. In this embodiment, attachment hardware 110 may be oriented so that light and sound bar system 100 may be attached to both vertical surfaces such as a wall, and horizontal surfaces such as a table top. In one embodiment, attachment hardware control 313 is a lever, that when actuated, is used to control a level of suction of suction cup attachment hardware 110. Swivel 844 may also include hardware to control a degree of rotation. In one embodiment, one or more swivels 844 must be pressed prior to rotation of attachment hardware 110. In another embodiment, swivel 844 includes detents to rotate attachment hardware 110 at fixed intervals such as 10 degree increments, 90 degree increments, and the like.

Figure 9:
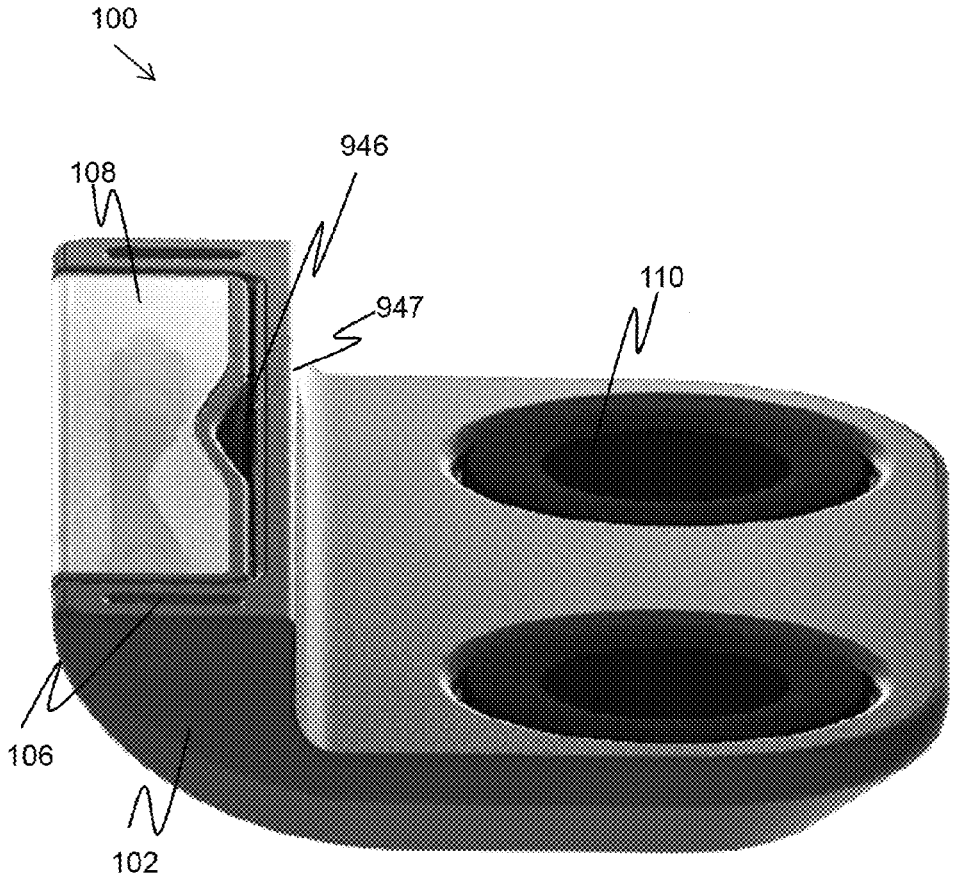
FIG. 9 illustrates a perspective view of another embodiment of a light and sound bar system.

Referring to FIG. 9, a perspective view of another embodiment of light and sound bar system 100 is provided. In one embodiment, light and sound bar system 100 may include one or more attachment hardware 110 such as a suction cup. In one embodiment, light and sound bar system 100 may include lighting device 108, such as a light bar with one or more LED attached to a flexible arm used to direct a light output of lighting device 108. In this embodiment, lighting device 108 includes finger indentation 946 to assist a user in removing lighting device 108 on flexible arm away from housing 102. Sound from high fidelity speaker contained in an inner volume of housing 102 is broadcast externally through one or more grille 106. Light and sound bar system may include overhang 947 to rest portion of light and sound bar system 100 on an edge of an auxiliary device on a planar surface different than a planar surface on auxiliary device to which attachment hardware 110 attaches.

Figure 10:
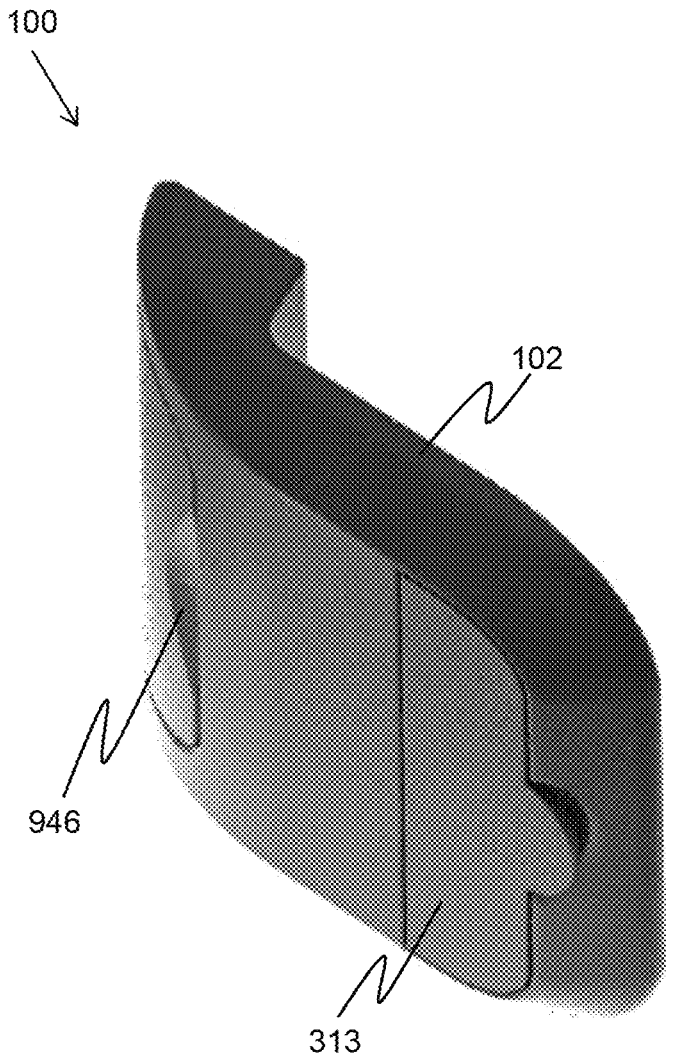
FIG. 10 illustrates a perspective view of another embodiment of a light and sound bar system.

Referring to FIG. 10, a perspective view of another embodiment of light and sound bar system 100 is illustrated. In one embodiment, attachment hardware control 313 is a lever that is actuated in one direction to induce suction in one or more attachment hardware 110 so as to attach light and sound bar system 100 to another object, and attachment hardware control 313 is actuated in an opposite direction to remove suction in one or more attachment hardware 110 so as to detach light and sound bar system 100 from another object.

Figure 11:
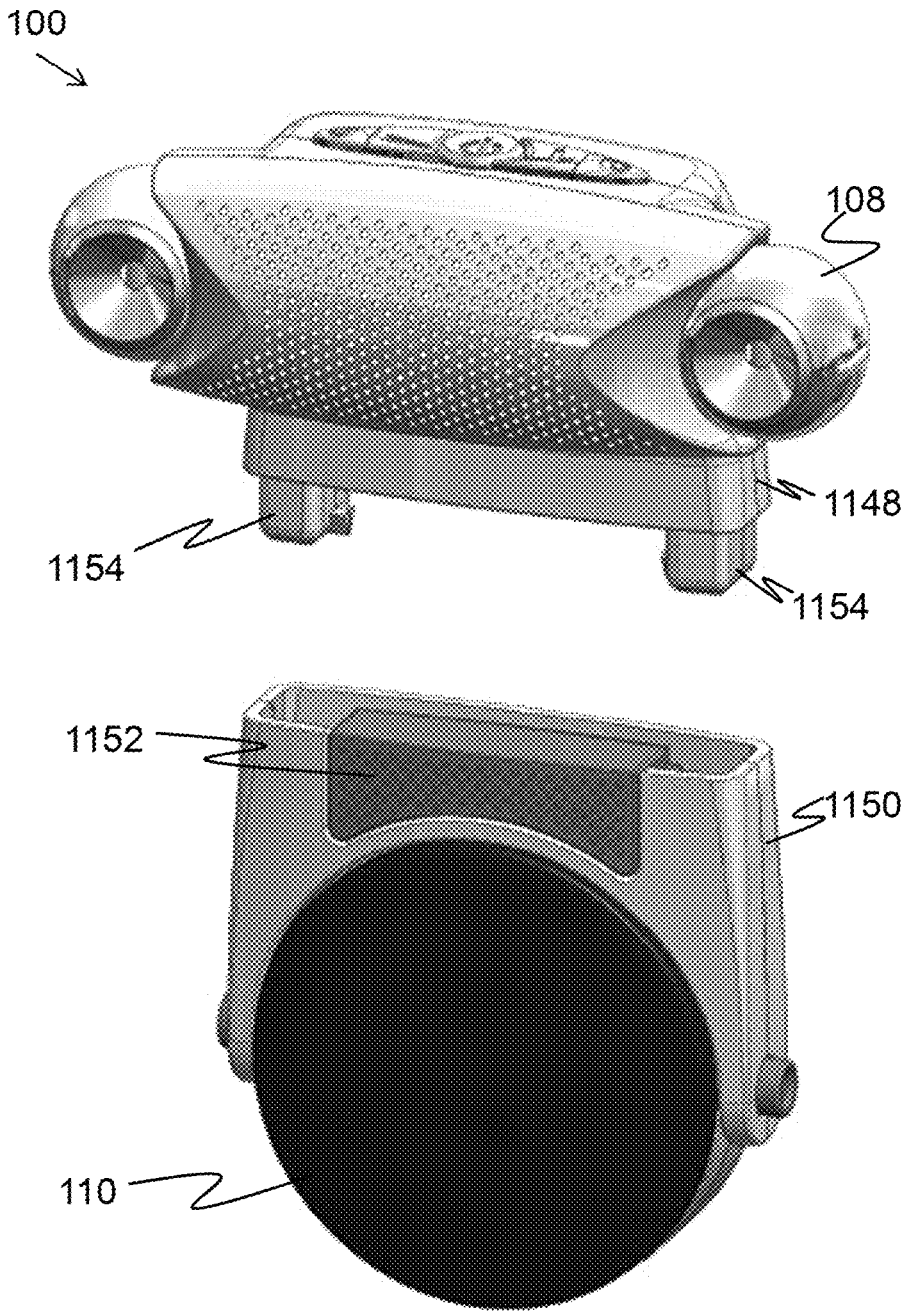
FIG. 11 illustrates a perspective view of one embodiment of a light and sound bar system.
Figure 12B:
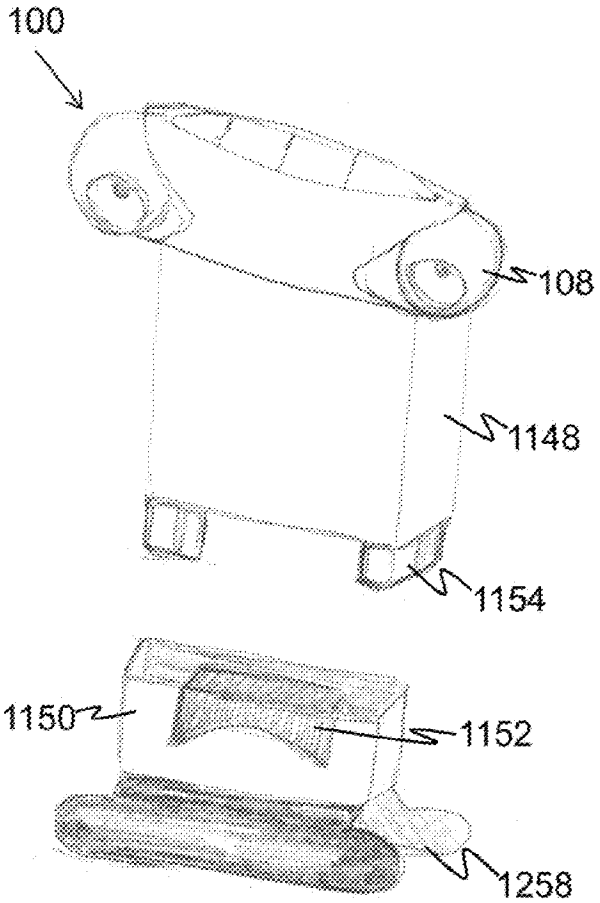
FIG. 12B illustrates a perspective view of one embodiment of a light and sound bar system.
Figure 12A:
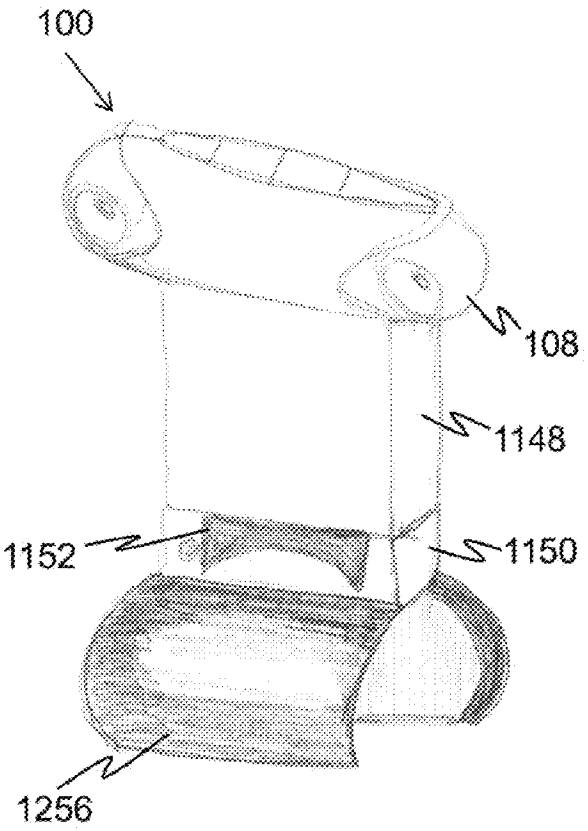
FIG. 12A illustrates a perspective view of one embodiment of a light and sound bar system.
Figure 13B:
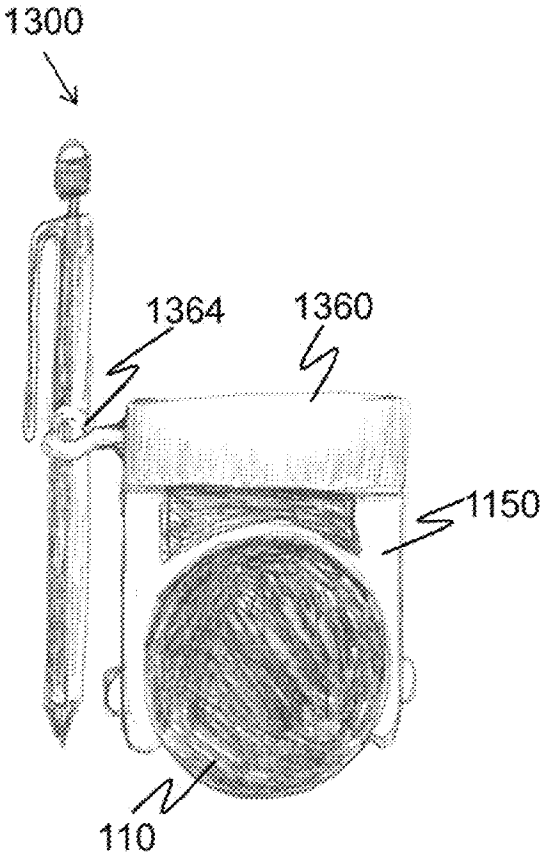
FIG. 13B illustrates a perspective view of one embodiment of a light and sound bar system.
Figure 13A:
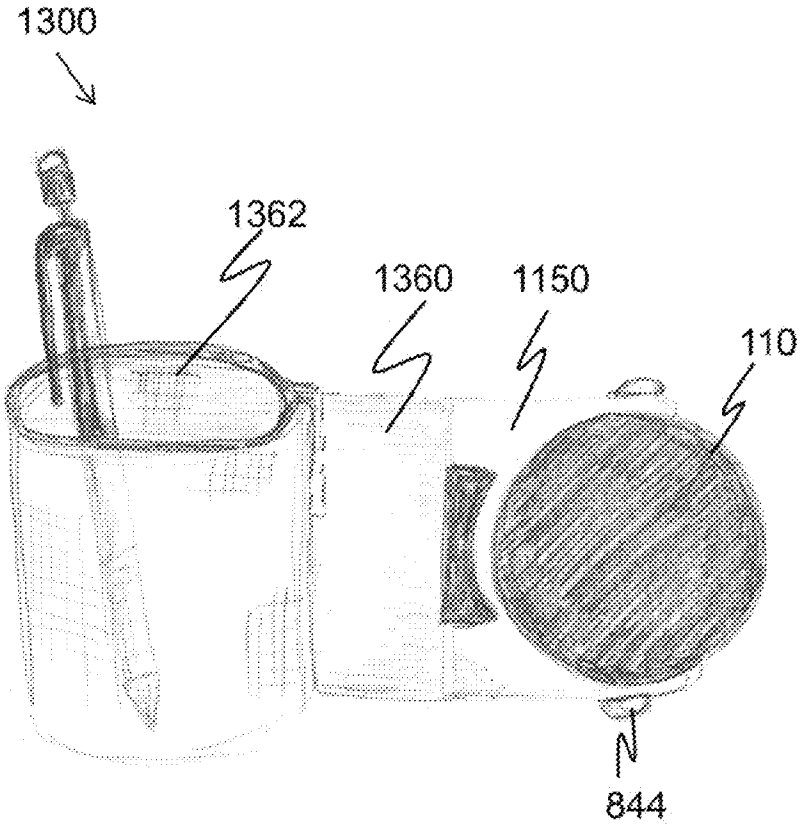
FIG. 13A illustrates a perspective view of one embodiment of a light and sound bar system.

Referring to FIG. 11, a perspective view of a detachable embodiment of light and sound bar system 100 is illustrated. In one embodiment, light and sound bar system 100 is detachable to allow lighting devices 108 and speakers (not shown) to be detached from attachment hardware 110. Internal components, as illustrated in FIG. 5, may all be housed in upper housing 1148 to allow for complete light and sound functionality. Upper housing 1148 may include modular functionality such that upper housing may be adapted to a variety of different bases such as lower housing 1150. In one embodiment, upper housing 1148 attaches to a base operable to mount on handlebars of a bicycle as illustrated in FIGS. 12A and 12B. In another embodiment, upper housing 1148 may be adapted to fit on a base including a cup or drink holder as illustrated in FIG. 13A. In another embodiment, upper housing 1148 may be adapted to fit on a storage unit for office supplies such as a pencil cup, storage box, and the like as illustrated in FIGS. 13A and 13B. Upper housing 1148 may detach from lower housing 1150 by depressing housing release 1152 to disengage modular housing connection hardware 1154, such as attachment prongs, to pull upper housing 1148 from lower housing 1150. Lower housing 1150 containing attachment hardware 110 may interface with another upper housing 1148 containing modular attachment connection hardware 1154. In one embodiment, upper housing 1148 containing lighting devices 108 and speakers (not shown) is replaced by another upper housing 1148 that does not include lighting or sound as shown in FIGS. 13A and 13B.

Referring to FIGS. 12A and 12B, a perspective view of a detachable embodiment of light and sound bar system 100 is illustrated. With reference to FIG. 12A, in one embodiment, upper housing 1148 may attach to a bottom housing 1150 with hardware 1256 operable to secure light and sound bar system 100 to a bicycle handlebar. With reference to FIG. 12B, upper housing 1148 may attach to lower housing 1150 with lower housing 1150 having a clip hardware 1258 thereon for attaching light and sound bar system 100 to items and surfaces using clip 1258. In one embodiment, clip 1258 may is a spring-loaded clip. In another embodiment, clip 1258 is a clamp system with a quick release clutch for securing light and sound bar system 100 to items.

Referring to FIGS. 13A and 13B, an alternative embodiment to light and sound bar system 100 is provided. In one alternative embodiment, modular aspects of light and sound bar system 100 may be adapted to provide additional functionality. In one embodiment, upper housing 1148 of light and sound bar system 100 may be replaced with another upper housing 1360 which may interface with lower housing 1150 of light and sound bar system 100. In this embodiment, no light and sound functionality is provided. Referring to FIG. 13A, in one alternative embodiment, upper housing 1360 may include a drink holder 1362 or storage unit for office supplies 1362 such as a pencil cup for holding writing devices and office supplies that interfaces with lower housing 1150 including attachment hardware 110. Referring to FIG. 13B, in another alternative embodiment, upper housing 1360 includes a writing instrument holder 1364 for holding a pencil, pen, stylus and the like. In this embodiment, upper housing 1360 is adapted to attach to lower housing 1150 with attachment hardware 110 of light and sound bar system 100.

Unless specifically stated to the contrary, the numerical parameters set forth in the specification, including the attached claims, are approximations that may vary depending on the desired properties sought to be obtained according to the exemplary embodiments. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

Furthermore, while the systems, methods, and apparatuses have been illustrated by describing example embodiments, and while the example embodiments have been described and illustrated in considerable detail, it is not the intention of the applicants to restrict, or in any way limit, the scope of the appended claims to such detail. It is, of course, not possible to describe every conceivable combination of components or methodologies for purposes of describing the systems, methods, and apparatuses. With the benefit of this application, additional advantages and modifications will readily appear to those skilled in the art. Therefore, the invention, in its broader aspects, is not limited to the specific details and illustrative example and exemplary embodiments shown and described. Accordingly, departures may be made from such details without departing from the spirit or scope of the general inventive concept. Thus, this application is intended to embrace alterations, modifications, and variations that fall within the scope of the appended claims. The preceding description is not meant to limit the scope of the invention. Rather, the scope of the invention is to be determined by the appended claims and their equivalents.

As used in the specification and the claims, the singular forms "a," "an," and "the" include the plural. To the extent that the term "includes" or "including" is employed in the detailed description or the claims, it is intended to be inclusive in a manner co-extensive with the term "comprising," as that term is interpreted when employed as a transitional word in a claim. Furthermore, to the extent that the term "or" is employed in the claims (e.g., A or B) it is intended to mean "A or B or both." When the applicants intend to indicate "only A or B, but not both," then the term "only A or B but not both" will be employed. Similarly, when the applicants intend to indicate "one and only one" of A, B, or C, the applicants will employ the phrase "one and only one." Also, to the extent that the terms "in" or "into" are used in the specification or the claims, it is intended to additionally mean "on" or "onto." To the extent that the term "selectively" is used in the specification or the claims, it is intended to refer to a condition of a component wherein a user of the apparatus may activate or deactivate the feature or function of the component as is necessary or desired in use of the apparatus. To the extent that the term "operatively connected" is used in the specification or the claims, it is intended to mean that the identified components are connected in a way to perform a designated function. Finally, where the term "about" is used in conjunction with a number, it is intended to include ±10% of the number. In other words, "about 10" may mean from 9 to 11.

What is claimed is:

1. A portable light and sound bar system, comprising:

a housing having an upper housing and a lower housing;

wherein the upper housing comprising :

an omnidirectional high fidelity speaker;

an adjustable lighting device;

an electrical input; a power source; and wherein the lower housing comprising:

an attachment hardware;

wherein the upper housing and the lower housing configured to selectively interconnect as modular fittings, wherein the upper housing is configured to at least one of:

selectively engage the lower housing via a modular housing connection hardware, the modular housing connection hardware configured to connect the upper housing to the lower housing, and selectively disengage the upper housing from the lower housing as to separate the upper housing from the lower housing;

rest on at least two distinct planar surfaces of an auxiliary device;

provide directional lighting via the directional lighting of the adjustable lighting device;

provide sound output from an output of the omnidirectional high fidelity speaker; swivel and rotate relative to the lower housing when the upper housing and the lower housing are selectively engaged; and wherein the lower housing is configured to selectively attach to the auxiliary device via the attachment hardware.

2. The portable light and sound bar system of claim 1, wherein the upper housing comprises:

an inner volume, the inner volume configured to support at least one of: the power source, circuity, omnidirectional high fidelity speaker hardware, and a storage area; and an outer surface, the outer surface configured to support at least one of: an omnidirectional high fidelity speaker output, an adjustable lighting device, and an attachment interface configured to interface with the attachment hardware.

3. The portable light and sound bar system of claim 1, wherein the portable light and sound bar system is waterproof.

4. The portable light and sound bar system of claim 1, wherein the electrical input comprises at least one of: an antenna, an audio jack, a receiver, a speaker terminal, a binding post, a USB connection, an IEEE 1394 connection, a serial connection, a parallel connection, a memory, a memory card reader, and a transceiver.

5. The portable light and sound bar system of claim 4, wherein an audio signal input into the light and sound bar system is either further processed by one of: a tuner, a demodulator, an amplifier, a decoder, and a filter; or wherein the audio signal input is output directly by the omnidirectional high fidelity speaker.

6. The light and sound bar system of claim 1, wherein the adjustable lighting device is at least one of: selectively adjustable to direct light from a light source and selectively extendable and retractable from a portion of the housing.

7. The light and sound bar system of claim 1, wherein the adjustable lighting device further comprises at least one of: a light source, a reflector, and a lens.

8. The light and sound bar system of claim 1, wherein the power source comprises at least one of: a battery, a rechargeable battery, and an external power source; and wherein the external power source is operable to connect to, and power, the light and sound bar system via an external power jack on an outer surface of the housing, or via the electrical input.

9. The light and sound bar system of claim 1, wherein the attachment hardware comprises a selectively attachable and detachable hardware for selectively attaching and detaching the light and sound bar system to a surface of an auxiliary device.

10. The light and sound bar system of claim 9, wherein the selectively attachable and detachable hardware is at least one of: a suction cup, an adhesive, a hook and loop fastener, a press fit connection, a threaded connection, a holster connection, and a clip and bracket connection.

11. The light and sound bar system of claim 1, further comprising an actuation device for controlling one or more operations of the light and sound bar system.

12. A portable light and sound bar system, comprising:

a housing, and an adjustable lighting device operatively connected to the housing;

the housing comprising an inner volume for supporting at least one of: a power source, a circuit, and a storage area, the housing further comprising an outer surface for supporting at least one of: an omnidirectional high fidelity speaker output, the adjustable lighting device, and an attachment interface for interfacing with an attachment hardware, the housing further comprising an omnidirectional high fidelity speaker, the housing further comprising a swivel for rotably adjusting at least a portion of the housing comprising the omnidirectional high fidelity speaker and the adjustable lighting device thereon;

the housing further comprising: an electrical input; the power source; and the attachment hardware, the attachment hardware configured to connect to either the attachment interface on the outer surface of the housing, or directly to the outer surface of the housing, wherein the attachment hardware is selectively removable from the attachment interface and outer surface housing.

13. The light and sound bar system of claim 12, wherein the electrical input is at least one of: an antenna, an audio jack, a receiver, a speaker terminal, a binding post, a USB connection, an IEEE 1394 connection, a serial connection, a parallel connection, a memory, a memory card reader, and a transceiver; and wherein an audio signal input is either further processed by one of: a tuner, a demodulator, an amplifier, a decoder, and a filter, or wherein the audio signal input is output directly by the omnidirectional high fidelity speaker.

14. The light and sound bar system of claim 12, wherein the power source is at least one of:

a battery, a rechargeable battery, and an external power source; and wherein the external power source is operable to connect to power the light and sound bar system via an external power jack on the outer surface of the housing or via the electrical input.

15. The light and sound bar system of claim 12, wherein the light and sound bar system is waterproof.

16. A portable light and sound bar system, comprising:

a housing, the housing comprising an inner volume for supporting at least one of: a power source; a circuit; and a storage area;

the housing further comprising an outer surface for supporting at least one of: a grille to protect an omnidirectional high fidelity speaker; an adjustable lighting device; an actuation device for controlling the portable light and sound bar system; an electrical connector operable to either connect to an external power source, or input a wired or wireless audio signal; and an attachment interface for interfacing with attachment hardware, the housing further comprising:

an access panel on the outer surface for access to at least portion of the inner volume;

at least one swivel for rotably adjusting at least a portion of the housing comprising the omnidirectional high fidelity speaker and the adjustable lighting device thereon; and a machined indentation for holding and supporting at least one of: a writing device, and a paper;

the housing further comprising the omnidirectional high fidelity speaker, the omnidirectional high fidelity speaker comprising at least one of:

a preamplifier;

an amplifier;

a driver, the driver selected from the group of: a subwoofer, a woofer, a midrange, a tweeter, and a supertweeter;

a crossover;

An enclosure;

an electrical connection; and one or more grille;

the housing further comprising the adjustable lighting device operatively connected to the housing, the adjustable lighting device connecting to the housing by at least one of: a ball and socket attachment, a multidirectional swivel, and a flexible arm;

the housing further comprising: the power source; and the attachment hardware, the attachment hardware configured to connect to the attachment interface on the outer surface of the housing, wherein the attachment hardware is selectively removable from the attachment interface.

17. The portable light and sound bar system of claim 16, wherein the electrical connector is at least one of: an antenna, an audio jack, a receiver, a speaker terminal, a binding post, a USB connection, an IEEE 1394 connection, a serial connection, a parallel connection, a memory, a memory card reader, and a transceiver; and wherein an audio signal input is either further processed by one of: a tuner, a demodulator, the amplifier, the preamplifier, the crossover, a decoder, and a filter; or wherein the input audio signal is output directly by the omnidirectional high fidelity speaker.

18. The portable light and sound bar system of claim 16, wherein the power source is at least one of: a battery, a rechargeable battery, and an external power source.

19. The portable light and sound bar system of claim 16, wherein the portable light and sound bar system is waterproof.

* * * * *